US010504300B2

(12) United States Patent
Costabile et al.

(10) Patent No.: US 10,504,300 B2
(45) Date of Patent: Dec. 10, 2019

(54) SYSTEM FOR REMOTELY STARTING AND STOPPING A TIME CLOCK IN AN ENVIRONMENT HAVING A PLURALITY OF DISTINCT ACTIVATION SIGNALS

(71) Applicant: Michael J Costabile, Shallotte, NC (US)

(72) Inventors: Michael J Costabile, Shallotte, NC (US); Dennis Brady Whitley, Cooleemee, NC (US)

( * ) Notice: Subject to any disclaimer, the term of this patent is extended or adjusted under 35 U.S.C. 154(b) by 179 days.

(21) Appl. No.: 15/743,803

(22) PCT Filed: Sep. 4, 2015

(86) PCT No.: PCT/US2015/048594

§ 371 (c)(1),
(2) Date: Jan. 11, 2018

(87) PCT Pub. No.: WO2017/039693

PCT Pub. Date: Mar. 9, 2017

(65) Prior Publication Data

US 2018/0204391 A1 Jul. 19, 2018

(51) Int. Cl.
*G10K 5/00* (2006.01)
*G07C 1/28* (2006.01)

(52) U.S. Cl.
CPC ..... *G07C 1/28* (2013.01)

(58) Field of Classification Search
CPC ..... G10K 5/00; A63B 71/02; G08B 7/06
See application file for complete search history.

(56) References Cited

U.S. PATENT DOCUMENTS 4,215,856 A * 8/1980 Schmall ..... G07C 1/22 273/460
5,293,354 A * 3/1994 Costabile ..... G04F 8/08 368/11
2003/0058744 A1* 3/2003 Calace ..... A63B 71/0605 368/109
2005/0195331 A1* 9/2005 Sugano ..... G11B 27/105 348/571
2010/0085167 A1* 4/2010 Costabile ..... A63B 71/0605 340/323 R
2010/0134614 A1* 6/2010 Aman ..... A63B 24/0003 348/135

(Continued)

FOREIGN PATENT DOCUMENTS

WO WO00/73858 A2 12/2000

OTHER PUBLICATIONS

Chinese Office Action dated Jun. 3, 2019.

*Primary Examiner* — James S. McClellan
*Assistant Examiner* — Kevin M Carter
(74) *Attorney, Agent, or Firm* — Carla Gannon Law

(57) ABSTRACT

A sports event time clock control system utilizing remotely activated game clock controls in which the sonic fingerprints including multiple harmonic frequencies of each official's whistle blow is compared with prerecorded sonic fingerprints of the officials for activation of the game clock upon a match in sonic fingerprints and to identify and record the official who blew the whistle along with the strength of the whistle blow. Sonic fingerprints include the strongest harmonic plus selected strong overtone and undertone frequencies.

7 Claims, 7 Drawing Sheets

(56) References Cited

U.S. PATENT DOCUMENTS

| | | | | |
|---|---|---|---|---|
| 2011/0263319 | A1* | 10/2011 | Hamalainen | G06Q 50/34 463/25 |
| 2012/0002509 | A1* | 1/2012 | Saguin | A63B 71/0616 368/3 |
| 2017/0186414 | A1* | 6/2017 | Ellingson | G10K 5/00 |

* cited by examiner

SYSTEM FOR REMOTELY STARTING AND STOPPING A TIME CLOCK IN AN ENVIRONMENT HAVING A PLURALITY OF DISTINCT ACTIVATION SIGNALS

This invention relates to a remote time clock activation and identification system for a game clock such as those used in basketball games.

In many sports, such as basketball, a contest is divided into specific time periods or durations of play which require accurate timing. The play periods are frequently interrupted for time outs including those for official or television commercial reasons, time outs allocated to each team, fouls called by the officials, and for time clock violations. Such fouls or actions requiring penalties must be assessed to the player committing the foul, and play is stopped to allow, for example, any applicable free throws resulting from the foul. In addition, officials may stop play for a wet floor or an injured player.

As a result, the official time clock is frequently started and stopped upon such actions of any of the officials or the timekeeper. Officials typically signal the stop and start of play by whistles and the corresponding starting and stopping of the official time clock is effectuated by the timekeeper pressing a button. Alternatively, the official time clock may be started and stopped remotely and automatically by the officials' whistles using equipment such as shown in U.S. Pat. No. 5,293,354, issued Mar. 8, 1994 to Michael J. Costabile and U.S. Pat. No. 7,920,052 issued Apr. 5, 2011 to Michael J. Costabile, both of which are hereby incorporated in their entirety.

Existing technology has limitations. For example, existing technology requires that the officials use a specific whistle that is recognized by the system. Moreover, existing technology recognizes only that a whistle has been blown, but can't identify the specific whistle. This is less than ideal because it is often desirable in a multi-whistle environment to know the specific whistle, and therefore the specific official, that actuated the time clock.

Identifying the specific whistle that actuates the time clock is important in a variety of situations. For example, problems may be encountered when there is an inadvertent blowing of the whistle by an official who may be reluctant to own up to the error, or even by a spectator, or inadvertent pressing of the start/stop button by the timekeeper. Being able to identify which official blew his whistle is also important when multiple whistles are blown, and when calls by officials are in question.

Also, sports operations staff for sports associations such as the National Basketball Association ("NBA") and college conference offices routinely review videotapes of all games in their quality and accuracy review of the calls by the officials, and to insure and preserve the integrity of the game. Officials do make mistakes which can affect which team wins a particular game. Moreover, the overall environment is often loud with shouting by spectators and bands playing. When officials are later determined to have made a serious error, particularly one affecting the outcome of a game, they may be punished such as by suspension for a specified period. The potential of after-game detection and punishment of officiating error encourages diligence and correct performance by officials. Moreover, because of potential bias or other improprieties, it is important that official calls be scrutinized, even after a game is completed.

Since officials frequently signal a game stopping event such as a foul by three or four quick whistle blasts, the blasts of two officials may be simultaneous or overlapping. An analysis for quality control review of the event is helped by the precise and reliable recording of the whistle blasts and identification of the officials involved.

Television replays are not designed to present an accurate review of the actions of officials and do not identify who blew a whistle first in the case of multiple whistles. Moreover, if television playback is slowed down to closely examine a play, the whistle blasts frequently become inaudible.

As a result, it is highly desirous to have a reliable record of each starting and stopping of play along with the identity of the initiator of such actions.

SUMMARY OF THE INVENTION

In accordance with one form of the invention, a record of the sonic fingerprint of the whistle blowing by the individuals officiating a sports event is digitally stored prior to commencement of the event, for subsequent comparison with whistles blown during the event in order to identify which individual blew the whistle during the event and to initiate actions, be it stopping play or starting play.

The sonic signal sensed by a microphone located close to the whistle worn by officials is passed through a band pass filter and then digitized for comparison with the stored signals to identify which official blew the whistle.

The band of frequencies obtained by a Fast Fourier Transform are processed to identify and store the highest amplitude resonant or center frequency signal. Also stored are the signals representing the next strongest resonant frequencies above and below the center frequency signal to provide a multiplicity of frequencies for comparison of the stored fingerprints with whistle blows during the sporting event. To minimize false acceptance and increase reliability while detecting a valid whistle, multiple parameters are measured and compared to the stored standard.

Those whistle signals for which there is a match are displayed and stored with identification of which official initiated the action and at what time the action was used to activate the official time clock, be it stopping play or starting play. They are also as indicated by the time clock response.

Many variables can affect how a whistle sounds each time it is blown, such as the way an individual blows air into it, or the way he/she holds it, or even the environment that it's in, whether inside a small room or a large gym or a crowded coliseum. Because of these variables, a certain level of tolerance must be accepted as to whether one whistle blow compares to another. But too much tolerance will cause false acceptances.

IDENTIFICATION OF DRAWINGS

DESCRIPTION OF THE INVENTION

As used herein, the following terms shall apply:

The following structure numbers refer to the following structures among the various figures:

10—Activation system;
20—Activation module;
22—Microphone;
23—Sonic signal;
25—Filter amplifier;
27—Voltage comparator;
28—Audio frequency signal;
29—Radio transmitters;
30—Base station;
31—Radio receiver;
32—Analog to digital converter;
33 Digital signal;
34—Fast fourier transform;
35—Frequency selection;
36—Fingerprint;
37—Comparator storage;
38—Comparator level control;
39—Central fingerprint file;
50—Whistle;
55—Whistle signal;
60—Game clock;
62—Clock actuation signal;
64—Game clock actuator;
66—Timekeeper control button;
70—Remote location;
100—First official;
101—Second official;
102—Third official; and
200—Timekeeper.

Figure 1:
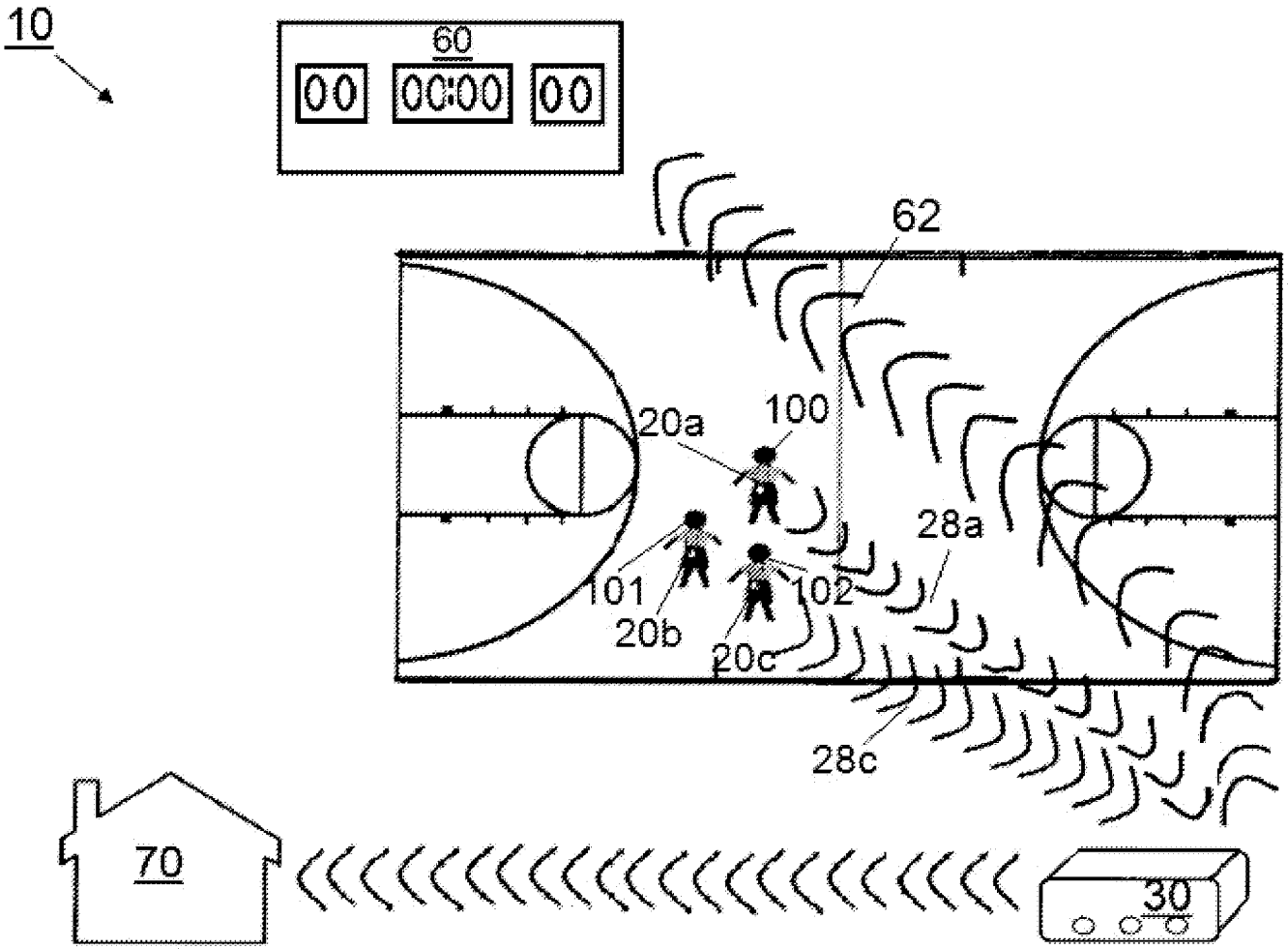
FIG. 1 is an overview of the activation system.

An overview of activation system 10 for a basketball game is depicted in FIG. 1. More specifically, officials 100, 101 and 102 are each outfitted with their own activation modules 20*a*, 20*b* and 20*c* respectively. As shown, officials 100 and 102 (but not 101) have blown their respective whistles, thereby activating their respective activation modules 20*a* and 20*c*, thereby sending audio frequency signals 28*a* and 28*c* from activation modules 20*a* and 20*c* to base station 30, thereby sending clock activation signal 62 from base station 30 to game clock 60, which signals the game clock to stop.

Figure 2:
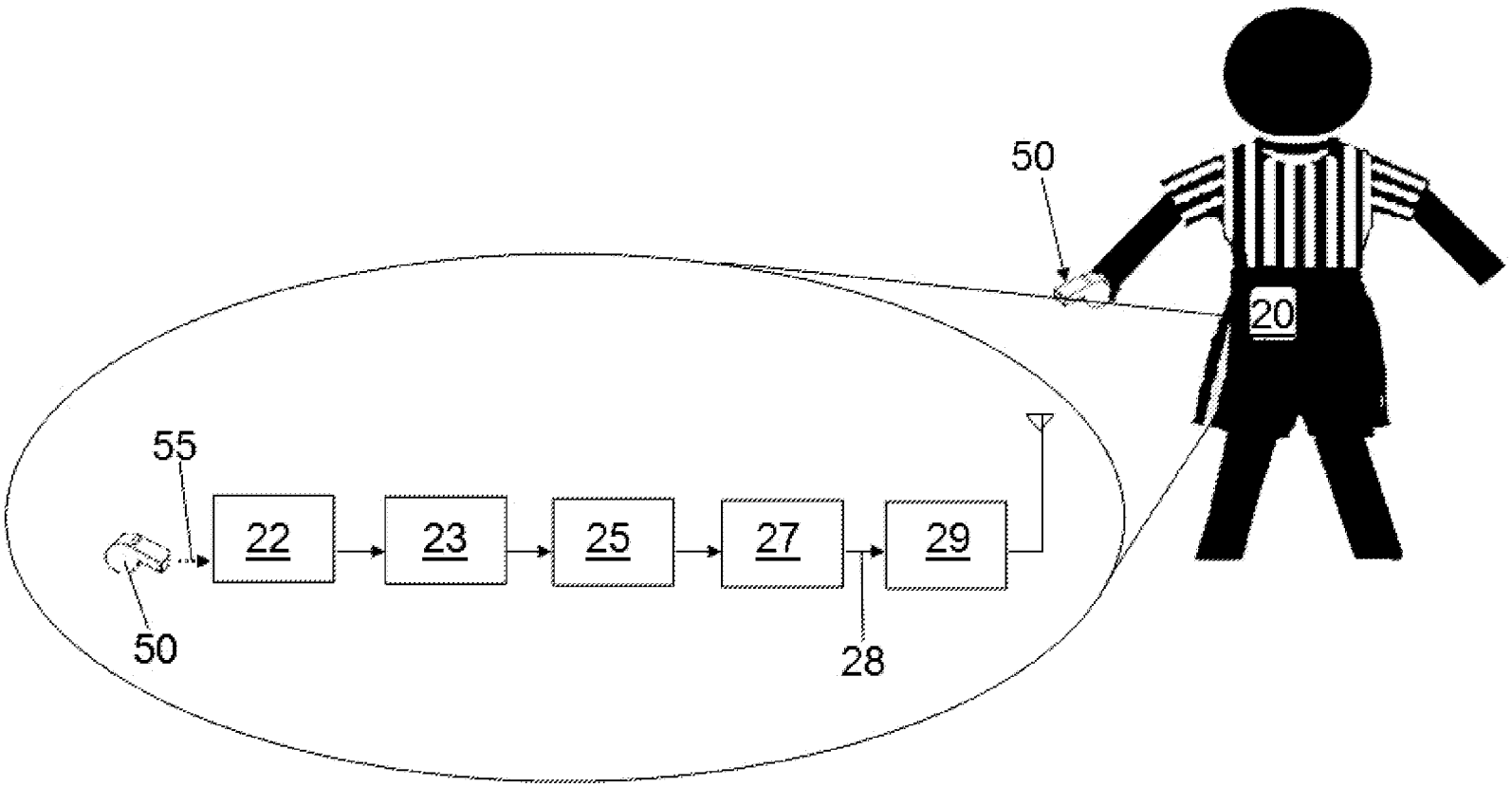
FIG. 2 depicts an official wearing an activation module, with a block diagram of associated hardware shown in an exploded view.

Referring to FIG. 2, activation module 20 is adapted to be worn by an official, and is activated when that official's specific whistle 50 produces whistle signal 55. Whistle 50 may be "Fox Classic 40" whistles manufactured by Fox 40 International, Inc. of Canada, which are standard in the NBA, and many college and high school basketball leagues. These whistles include no moving parts and emit an audible sonic signal around 3150 hertz. The system of the present invention may be made particularly responsive to that whistle by being tuned to 3150 hertz, although the system may be readily tuned to accommodate other whistle types or audible signaling devices operating at other frequencies including blow horns, alarms, musical instruments, and digital noisemakers.

Each official, 100, 101 and 102 carries one microphone 22 in close proximity to their whistle 50, preferably attached to the official's whistle cord, or on their shirt in the vicinity of the neck portion.

Microphones 22 produce sonic signals 23 which pass through filter amplifiers 25 which include a multi-feedback band-pass filter which has somewhat sharp rejection drop-offs at the outer band frequencies, for example the following parameters:

Multiple Feedback Band Pass @ 3 KHz
Damping Ratio=1.01 Q=0.493
Gain ×20 Amplifier
Lower Freqcutoff @ −3 db=~1.25 KHz
Upper Freqcutoff @ −3 db=7.5 KHz
HPF Slope 2 KHZ to 200 HZ=−12 db/decade
LPF Slope 6 KHZ to 600 KHZ=−24 db/decade
LPF Slope 600 KHz to 6 MHz=−48 db/decade The sharp rejection of the outer bands helps eliminate unwanted harmonics and other frequencies with large amplitudes such that they are not further processed. The signal within the band pass is amplified to a usable level without clipping, since clipping would cause harmonics that could result in a false detection.

Amplified sonic signals 23 are sampled by voltage comparator 27 to determine if they are of a large enough amplitude or strength for further processing. The signal sensitivity level determines which signals pass through voltage comparator 27. The selected audio frequency signals 28 are then transmitted by radio transmitters 29 to base station 30 shown in FIG. 3.

Figure 5:
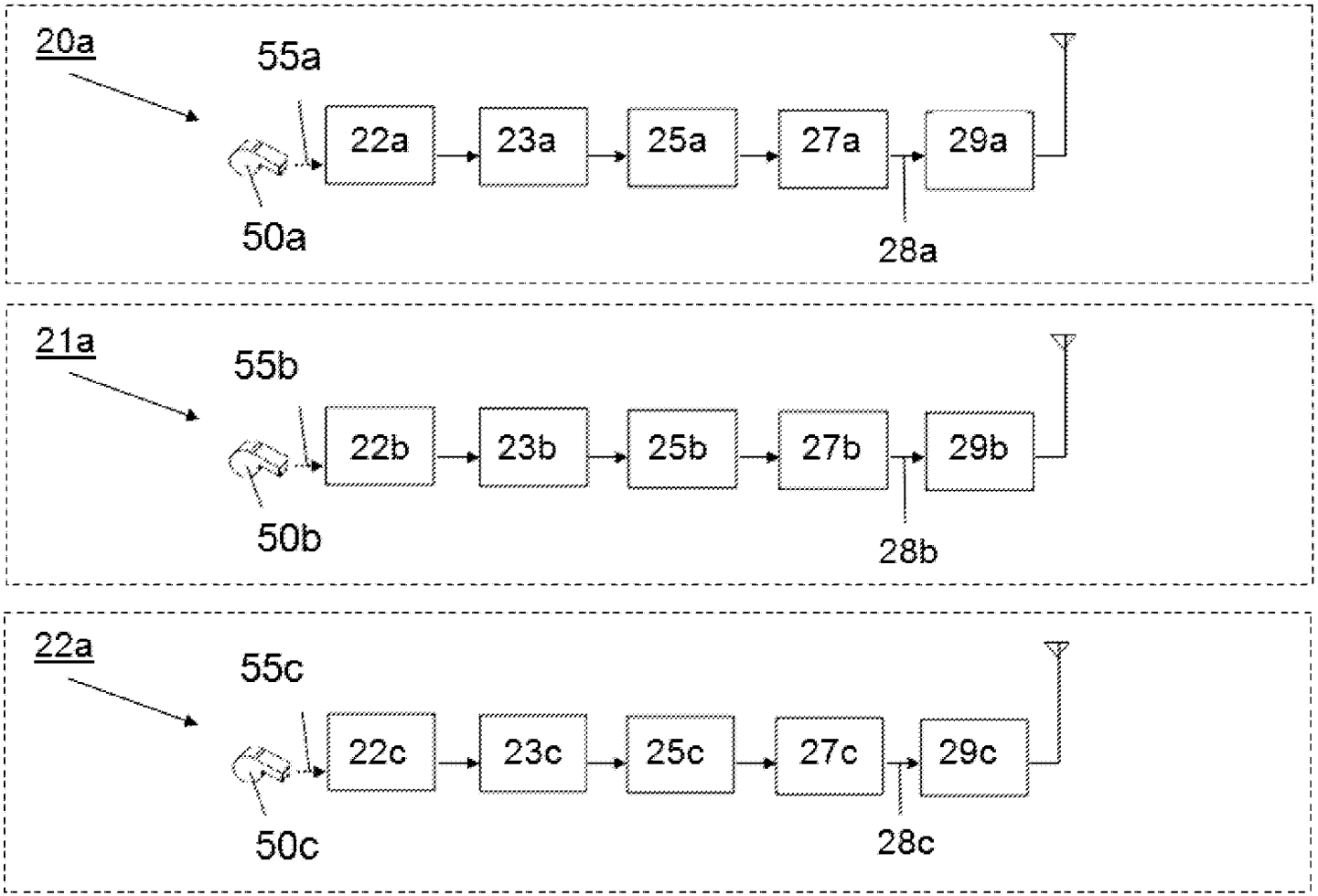
FIG. 5 depicts three block diagrams of hardware associated with three activation modules.

Referring for a moment to FIG. 5, each official wears one activation module 20 (20*a*; 20*b* or 20*c*) which is specifically calibrated for use with one whistle 50 (50*a*; 50*b*; or 50*c*, respectively).

Figure 3:
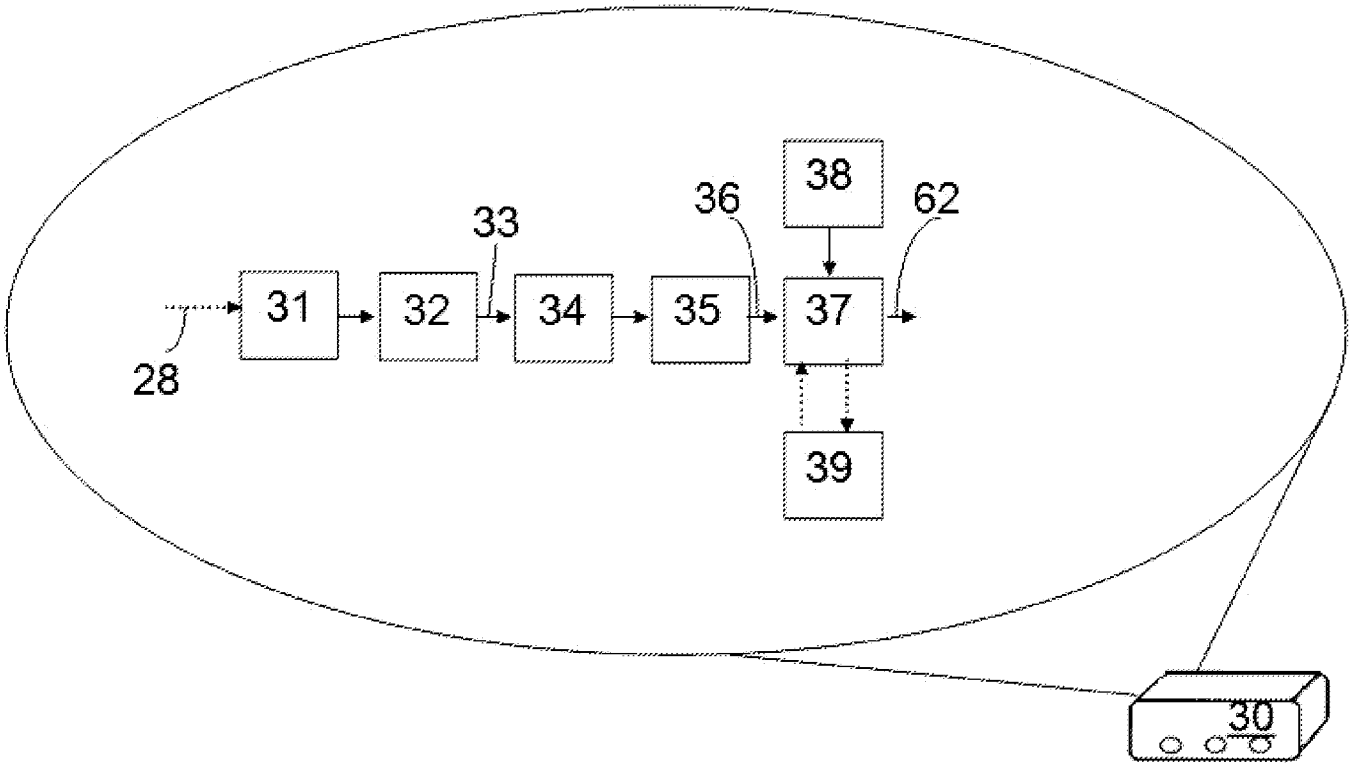
FIG. 3 depicts a base station, with a block diagram of associated hardware shown in an exploded view.

Referring next to FIG. 3, the selected audio signals 28 are received by radio receiver 31 and provided to analog to digital converter 32 for conversion to digital signal 33 representing whistle signals 55. Digital signal 33 is then processed by fast fourier transform 34 which is configured within the frequency band pass of filter-amplifier 25 to convert the time based signal data into a frequency based signal. This allows processing the frequency based data by frequency selection 35 to determine the center frequency of whistles 50 by selecting the frequency with the highest amplitude. This center frequency is then passed as part of sonic fingerprint 36 for storage in comparator storage 37 as the center frequency.

Figure 7:
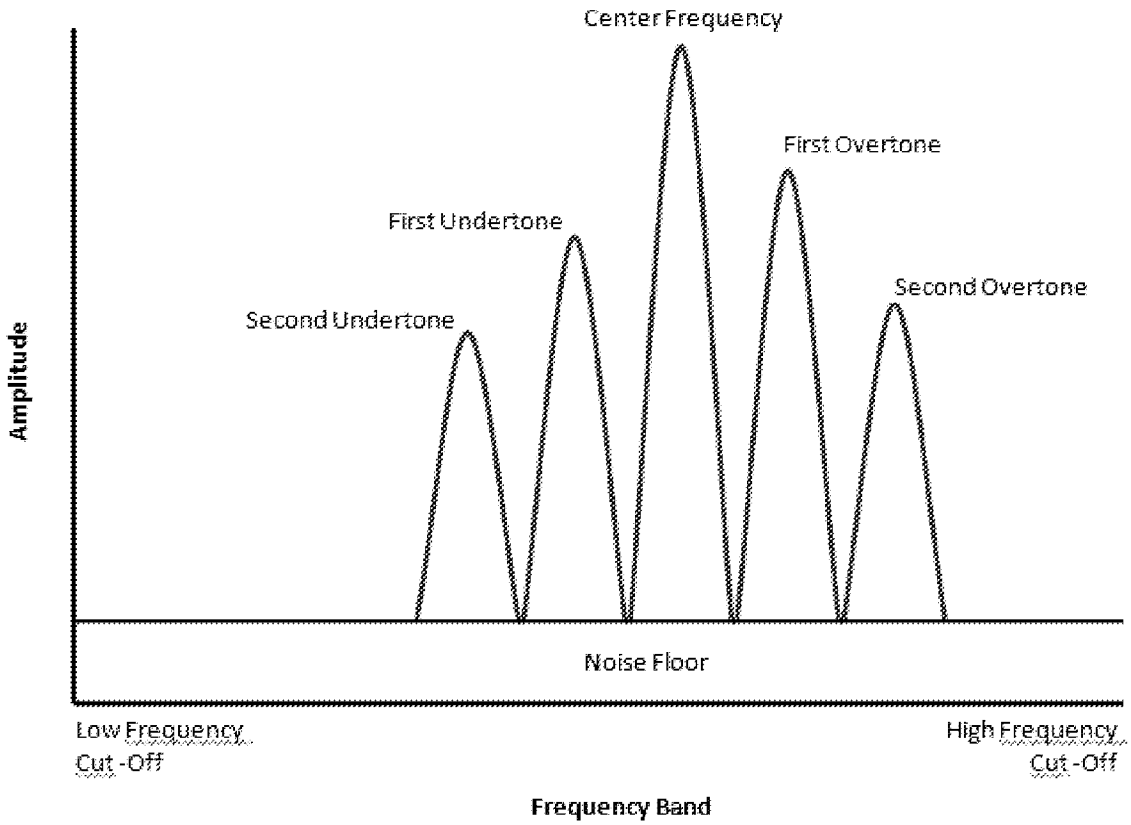
FIG. 7 is a whistle fingerprint.

Referring to FIG. 7, since many whistle types have similar center frequencies, additional frequencies in audio whistle signal 55 are collected to form a reliable sonic fingerprint containing multiple frequencies including both overtone and undertone frequencies in addition to the center frequency.

The next highest amplitude signal within the band of frequencies above the center frequency is taken and stored as the first upper harmonic frequency, after which the next highest amplitude within the band of frequencies above the first upper harmonic frequency is taken and stored as the second upper harmonic frequency which together form the overtone frequencies.

The selection from the frequencies below the center frequency or undertone frequencies include those two frequencies with the next highest amplitude below the center frequency to obtain a sonic fingerprint 36 of the whistle blow including a center frequency and two overtone frequencies above and two undertone frequencies below the center frequency.

These five frequencies shown on FIG. 7 form a sonic fingerprint 36 of the official who blew whistle 50. A sample sonic fingerprint 36 of each official taken before the beginning of the sports event is stored in comparator storage 37 as the standard sample sonic fingerprint of the particular whistle blow of an official after which all subsequent sonic fingerprints 36 are compared. This step is set forth on as the $5^{th}$ step on FIG. 6, "Calibrate Whistles."

Subsequent sonic signals 23 pass through the filter of amplifier filter 25 which then pass through the level setting of voltage comparator 27 (see FIG. 2) and are sent to base station 30 where they are processed by fast fourier transform 34, just as the standard sample, to find its center frequency and if there is a match as determined by frequency selection 35 the remaining four harmonics are averaged and compared to the average of the four similar frequencies of the standard sample's harmonics in the comparator storage 37.

Referring back to FIG. 3, if the averages are determined by comparator storage 37 to be within the tolerance as set by the operator by comparator level control 38, this is considered a match and a clock actuation signal 62 is sent to game clock actuator 64 to activate game clock 60. If either comparison of the center frequency or the harmonics average of the sonic signal and those of the stored sample do not match then the signal is rejected.

Figure 4:
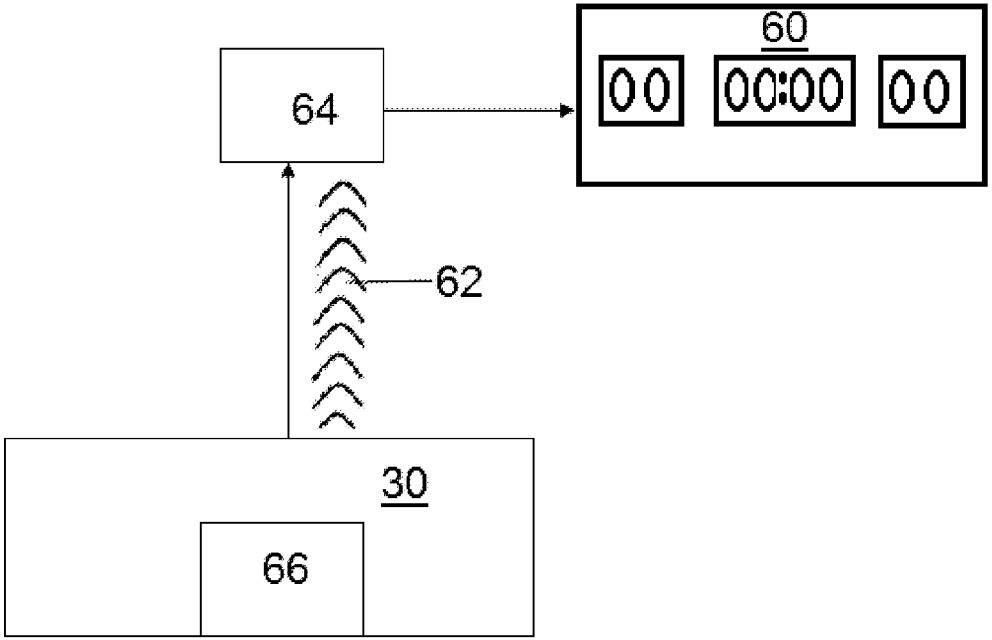
FIG. 4 depicts hardware and signals associated with stopping a game clock.

As shown in FIG. 4, timekeeper control button 66 is provided to enable the timekeeper to manually activate game clock 60 through game clock actuator 64.

Once the desired signal match level or strength is set by the timekeeper the system not only passes and identifies all whistle signals which meet or exceed the match level but also records in percent (%) the actual level. This enables the identification of those officials with a weak or barely passable whistle blowing level to enable instructing those officials to blow their whistle more strongly to avoid any possibility of very weak whistle blows for which the subject time clock activation and identification system would be unresponsive.

It is preferable that the standard samples of the officials' sonic fingerprints are obtained and stored shortly before commencement of play by having each official blow his or her whistle 50 for that purpose. (Step 5 of FIG. 6). This is preferably done in the environment in which the sporting event will be played. However in circumstances where it is difficult or impossible to calibrate under ideal conditions, a central sonic fingerprint file 39 can be established which may be remotely accessed and used. Such a file may be maintained at the conference level in college basketball since persons from the same group of officials are generally selected to officiate at games within the conference, or it could be maintained for a geographic area for the same reasons. Alternatively it could be maintained by the manufacturer of the subject equipment or at a central headquarters location if available, such as at the NBA.

Sonic fingerprints stored in central sonic fingerprint file 39 at a remote location 70 can be provided to the comparator storage 37 as needed, usually by the official timekeeper, prior to the sporting event.

Figure 6:
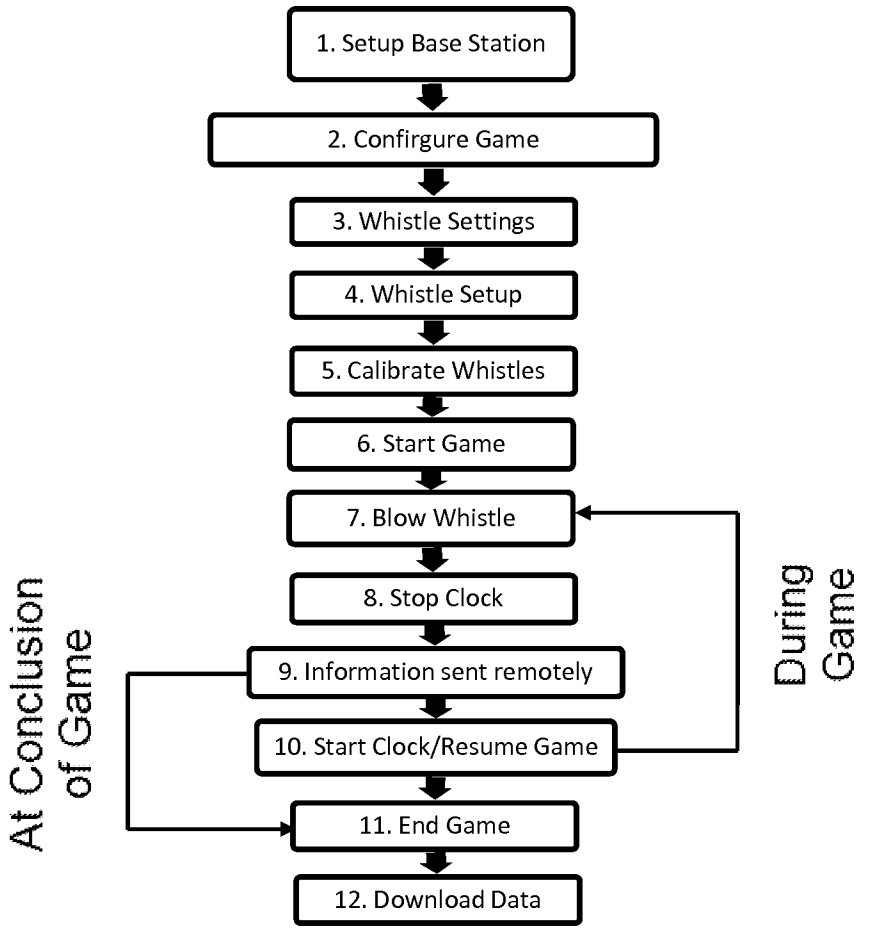
FIG. 6 is a block diagram of method of using the system.

A method of using system 10 is set forth in FIG. 6. In step 1 the base station is set up by performing steps such as connecting the power supply, connecting game clock and data cables, connecting an Ethernet cable, raising the antenna, and powering on. In step 2 the game is configured by entering information such as names of officials. This is typically performed at remotely and the data is automatically imported upon booting the system, but can be accomplished on site as well. Step 3 is setting the whistle settings including match threshold, preferably approximately 90%, and sensitivity level (Amplified Signal Peak Voltage Level), preferably approximately 23 for a lanyard style microphone setup having 1 microphone, or approximately 20 for a lapel style microphone setup having 2 microphones. In step 5 each individual whistle is calibrated by blowing the whistle several times with the microphone in the proper location until system prompts user that a reliable reading was taken. In step 6 the game is started as usual, with whistle blows (step 7) stopping the game clock (step 8). Data related to game clock stops, for example when clock stopped in real time, and identity of official who blew their whistle, is sent to remote location for further analysis and back-up. In step 10 the game is resumed until a whistle is blown again (step 7), or the game is ended (step 11). Data is downloaded at conclusion of game (step 12).

It should be understood, of course, that the foregoing relates to exemplary embodiments of the invention and that modifications may be made without departing from the spirit and scope of the invention as set forth in the following claims. By way of example, the system could be used in connection with other time-sensitive games and sports such as soccer, football, team handball, water polo, volleyball, wrestling and lacrosse. Also, a variety of different noisemakers, including bullhorns, musical instruments, alarms and/or and digital noisemakers could be used. Also, instead of stopping a time clock, the present invention could be modified to initiate a camera upon an auditory signal such as opening a door, squeaking a floor board, or breaking a window, which has security applications. Also, the system could be modified to identify which gun has been shot in an environment having multiple weapons. This could have security, gaming, hunting, and/or law enforcement applications. The system could also be modified to recognize certain sounds such as emergency vehicles, specific crying babies, specific animals, machine failure, and so forth, and activate the desired apparatus such as camera, lights, medical equipment, signal notification device, and so forth. As used herein, "approximately" and the like shall mean+/−10%, unless such a range would be nonsensical, such as a negative length. All ranges set forth shall include the endpoints themselves, as well as all increments there between.

What is claimed is:

1. A sports event time clock remote control system comprising:

a game clock;

a plurality of whistles each adapted to be carried by a plurality of officials;

each of said whistles providing a sonic signal when activated by the official carrying said whistles;

a means to analyze each of said sonic signals to determine which of said officials activated a whistle, wherein said means to analyze provides at least two harmonic frequencies above and at least two harmonic frequencies below, said dominant harmonic frequency, each of which are the next highest amplitude to said dominant harmonic frequency and wherein said harmonics above and said harmonics below said dominant frequency are averaged, and those averages within a preset tolerance parameter provide a control signal indicating that a whistle has been detected and provided to a base station for identification, said base station provided to store said sonic fingerprint signals for comparison with sonic fingerprint signals generated during said sports event to establish a match used for actuation of said game clock, and wherein said stored sonic signals are provided by each official blowing their game whistle shortly prior to the commencement of the sports event in the environment of said sports event;

said means to analyze, including a band pass filter that passes the frequencies of said whistles, for determining the dominant harmonic frequency of each sonic signal plus at least one overtone harmonic above and one undertone harmonic below said dominant harmonic frequency to generate sonic fingerprints, wherein those sonic fingerprints, which match a prerecorded sonic fingerprint, are utilized to identify the official generating said sonic fingerprint, and to record the identity and the time thereof as shown by said game clock;

means to compare the sonic fingerprints generated during said sporting event with the prerecorded sonic fingerprint of each official; and means to generate a game clock actuating signal in response to those sonic fingerprints generated during a game which match a prerecorded sonic fingerprint, wherein an analog to digital converter and fast fourier transform network working within the frequency bypass of said band pass filter are provided to convert time based signals to frequency based signals.

2. The sports event time clock remote control system of claim 1 wherein a signal comparator is provided to exclude those signals which are below a predetermined signal level.

3. The sports event time clock remote control system of claim 1 including a remotely accessible sonic fingerprint file to provide a sonic fingerprint signal of one or more of the officials officiating a particular sports event.

4. A remote time clock control, and identification system for officials in a sporting event comprising:

a game clock for the sporting event;

a whistle adapted to be blown by each of the officials to generate a sonic signal to control the starting and stopping of play in said sporting event;

a pack adapted to be carried by each of said officials which transmits said sonic signal to a base unit;

said base unit converting said sonic signal to a sonic fingerprint signal, wherein each of said sonic fingerprint signals includes at least two of the next strongest harmonics above and two of the next strongest harmonics below the frequency of the strongest harmonic to provide said sonic fingerprint;

said base unit including means for containing a sonic fingerprint file with the sonic fingerprints of each of said officials;

said base unit including means to compare said sonic fingerprint signals with those in said fingerprint file; and means to generate a time clock actuating control signal upon a match in said sonic fingerprint signals, wherein said match in said sonic fingerprint signals is utilized to identify the official who blew the whistle generating said match and means are provided to record said identity and the time as indicated by said game clock, and wherein the strength of each said match is recorded to enable the identification of those officials who may have low whistle strength for the purpose of subsequent improvement in said whistle strength.

5. The remote time clock control and identification system of claim 4 in which said sonic signal is passed through a band pass filter and subsequently through a fast fourier transform in advance of said comparing of said sonic fingerprint signals.

6. The remote time clock control and identification system of claim 4 wherein means are provided to average the harmonic signals on either side of said strongest harmonic prior to said comparing of said signals.

7. The remote time clock control and identification system of claim 4 including a repository of sonic fingerprints of officials who may officiate said sports event and said repository is remotely accessible prior to said sports event for storage in said base unit for said comparison with said sonic fingerprint signals produced during said sports event.

* * * * *